US008381623B2

(12) United States Patent
Block et al.

(10) Patent No.: US 8,381,623 B2
(45) Date of Patent: Feb. 26, 2013

(54) MATERIAL TRIMMER WITH ILLUMINATED CUT LINE INDICATOR

(75) Inventors: Andrew P. Block, Middleton, WI (US); Douglas R. Nelson, Madison, WI (US); Joshua D. Hatch, Middleton, WI (US); Scott Roelke, Arena, WI (US)

(73) Assignee: Fiskars Brands, Inc., Madison, WI (US)

( * ) Notice: Subject to any disclaimer, the term of this patent is extended or adjusted under 35 U.S.C. 154(b) by 490 days.

(21) Appl. No.: 12/638,530

(22) Filed: Dec. 15, 2009

(65) Prior Publication Data

US 2011/0138982 A1 Jun. 16, 2011

(51) Int. Cl.
*B26D 7/02* (2006.01)
*B26D 1/04* (2006.01)

(52) U.S. Cl. ..... 83/520; 83/455; 83/485; 83/614; 362/33

(58) Field of Classification Search ..... 83/520, 83/521, 522.11, 614, 455, 485; 33/286, 348; 362/119, 33
See application file for complete search history.

(56) References Cited

U.S. PATENT DOCUMENTS

| | | | | |
|---|---|---|---|---|
| 3,410,994 | A * | 11/1968 | Facto | 362/89 |
| 4,038,124 | A * | 7/1977 | Griswold et al. | 156/248 |
| 4,503,740 | A * | 3/1985 | Brand et al. | 83/521 |
| 4,769,747 | A * | 9/1988 | Parrillo | 362/89 |
| 4,913,020 | A * | 4/1990 | Hoonsbeen et al. | 83/471.2 |
| 5,322,001 | A | 6/1994 | Boda | |
| D379,193 | S | 5/1997 | Cornell | |
| 5,802,942 | A | 9/1998 | Cornell et al. | |
| 5,996,459 | A | 12/1999 | Cornell et al. | |
| 7,011,008 | B2 | 3/2006 | McLean et al. | |
| 7,299,731 | B2 | 11/2007 | Schulz | |
| D559,304 | S | 1/2008 | Lam et al. | |
| D559,305 | S | 1/2008 | Lam et al. | |
| D559,306 | S | 1/2008 | Lam et al. | |
| D559,307 | S | 1/2008 | Lam et al. | |
| 7,467,876 | B2 * | 12/2008 | Segawa | 362/244 |
| D593,598 | S | 6/2009 | Phillips et al. | |
| D593,599 | S | 6/2009 | Peterson et al. | |
| D607,501 | S | 1/2010 | Peterson et al. | |
| 7,770,502 | B2 * | 8/2010 | Parrish et al. | 83/522.15 |
| 2003/0140761 | A1 | 7/2003 | Schulz | |
| 2004/0221705 | A1 | 11/2004 | Vossler et al. | |
| 2007/0169602 | A1 | 7/2007 | Peterson et al. | |
| 2007/0277663 | A1 * | 12/2007 | Eby et al. | 83/651 |
| 2008/0250909 | A1 * | 10/2008 | Sudmalis et al. | 83/455 |
| 2009/0293694 | A1 | 12/2009 | Petersen et al. | |

FOREIGN PATENT DOCUMENTS

WO WO 2007/133657 A1 11/2007

OTHER PUBLICATIONS

Fiskars Craft Products 2007 catalog, pp. 30-39.

* cited by examiner

*Primary Examiner* — Laura M. Lee
(74) *Attorney, Agent, or Firm* — Foley & Lardner LLP

(57) ABSTRACT

A material cutting system for trimming sheet material having a base, a blade engageable with the sheet material along a cut line and a material guide including an illuminated surface indicative of the location of the cut line. In one set of embodiments, an illuminating assembly produces light that is internally transmitted through a light guide portion of the material guide to the illuminated surface. The illuminated surface provides for ready and correct orientation of the sheet material to the desired position for cutting by the material trimmer.

12 Claims, 10 Drawing Sheets

MATERIAL TRIMMER WITH ILLUMINATED CUT LINE INDICATOR

FIELD OF THE INVENTION

The present invention relates generally to the field of devices for cutting sheet material. More particularly, the present invention relates to devices for cutting sheet material, where the device includes an illuminated indicia representative of the cut line of the device.

BACKGROUND OF THE INVENTION

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Various conventional systems for trimming sheet material are known. However, it is often difficult or time consuming to orientate and align the sheet material in these systems so that the material may be readily cut at the desired location. The inability to correctly and efficiently determine the location of the cut line using a conventional material trimmer may result in substantial waste and inefficiency.

By way of example, one type of conventional paper trimmer provides a relatively long blade rotatably attached to a base. The trimming operation is performed by progressively lowering the blade along the length of the sheet material to be trimmed. However, it is generally difficult to accurately predict the precise location of the cut line prior to cutting the sheet material using such a system. Further, orientation of the material within and operation of such systems pose substantial safety risks. Another conventional material trimming system generally comprises a blade attached to a carriage adapted to slidingly translate on a guide along the length of the sheet material. However, these systems often conceal the sheet material beneath the guide and or a bulky carriage. Again, orientation and alignment of the sheet material within these material trimmers is difficult and or imprecise and reliable detection of the cut line prior to cutting can be difficult to identify.

SUMMARY

Various embodiments of the present invention comprise systems for efficiently cutting sheet material by providing an illuminated indicia of the location of the cut line of a material trimmer prior to cutting the sheet material. The illuminated indicia is visible to an operator during the positioning of the sheet material in the material trimmer and the cutting of the sheet material using the material trimmer, enabling an efficient and precise orientation of the sheet material within the material trimmer prior to cutting, and thereby reducing waste.

Embodiments of a material trimmer include an internally illuminated surface that is indicative of the position of the cut line and positioned near the sheet material to be cut. The material trimmer may be configured such that the illuminated surface is disposed proximate the blade portion of a cutting mechanism so that a close and reliable indication of the cut line location is provided to an operator. The illuminated surface may define a portion of an opening in a material guide that is selectively positionable over sheet material positioned on a base of the material trimmer. In this configuration, a bottom edge of the illuminated surface may be placed directly over the sheet material, and the approximate location of cut line is identified regardless of thickness or surface imperfections of the sheet material. Additionally, because the illuminated surface is internally illuminated, illumination and indication of the cut line is not disturbed or obstructed by external factors.

In an embodiment, an illuminated cutting system for cutting sheet material comprises a base configured to receive the sheet material and a material guide coupled to the base. The material guide is selectively rotatable between a material loading orientation and a cutting orientation. The material guide is located above the sheet material and is configured to hold the sheet material against the base when in the cutting orientation. The material guide includes a blade opening with an illuminated surface. When the material guide is in the cutting orientation, the illuminated surface is substantially perpendicular to the sheet material, with the illuminated surface including an edge indicative of a cut line that is disposed proximate the sheet material and proximate a path of travel of a cutting mechanism blade across the sheet material. The cutting system further comprises an illuminating assembly in optical communication with the material guide and electrically coupled to a power source. The illuminating assembly includes a light source positioned to transmit light through a portion of the material guide and illuminate the illuminated surface. The cutting system also includes a cutting mechanism guide coupled to at least one of the base and the material guide. Sheet material is alignable in relation to the illuminated surface for cutting in the illuminated cutting system.

In another embodiment, a cutting system for trimming sheet material, comprises a material guide having an opening locatable over a base. The base is configured to receive the sheet material such that the sheet material is located below the material guide. The opening defines a cutting path of a moveable cutting mechanism operatively coupled to the base and configured to engage the sheet material along the cutting path. The cutting system further comprises an illuminated cut line surface defining a portion of the opening and disposed proximate the material cutting path. The illuminated cut line surface is in optical communication with a light source via a light guide portion of the material guide. The light guide portion comprises a light incidence surface disposed proximate to the light source and a first light reflecting surface orientated substantially perpendicular to the illuminated cut line surface. The illuminated cut line surface is indicative of the position of a cut line formed in the sheet material upon engagement of the cutting mechanism with the sheet material along the cutting path.

In yet another embodiment, a system for cutting sheet material, comprises a base configured to receive the sheet material and a cutting mechanism having a blade. The cutting mechanism is operatively coupled to the base and engageable with the sheet material along a cut line. A material guide is coupled to the base and includes an alignment surface disposed above and proximate the sheet material. The material guide substantially indicates the location of the cut line. An illuminating assembly includes at least one light emitting diode in optical communication with the material guide, and a power supply is selectively electrically coupled to the illuminating assembly. A portion of the material guide internally transmits light emitted from the illuminating assembly to the alignment surface, thereby providing an illuminated visual indicia of the cut line.

These and other features of the invention, together with the organization and manner of operation thereof, will become apparent from the following detailed description when taken in conjunction with the accompanying drawings, wherein like elements have like numerals throughout the several drawings described below.

DETAILED DESCRIPTION OF VARIOUS EMBODIMENTS

Figure 1:
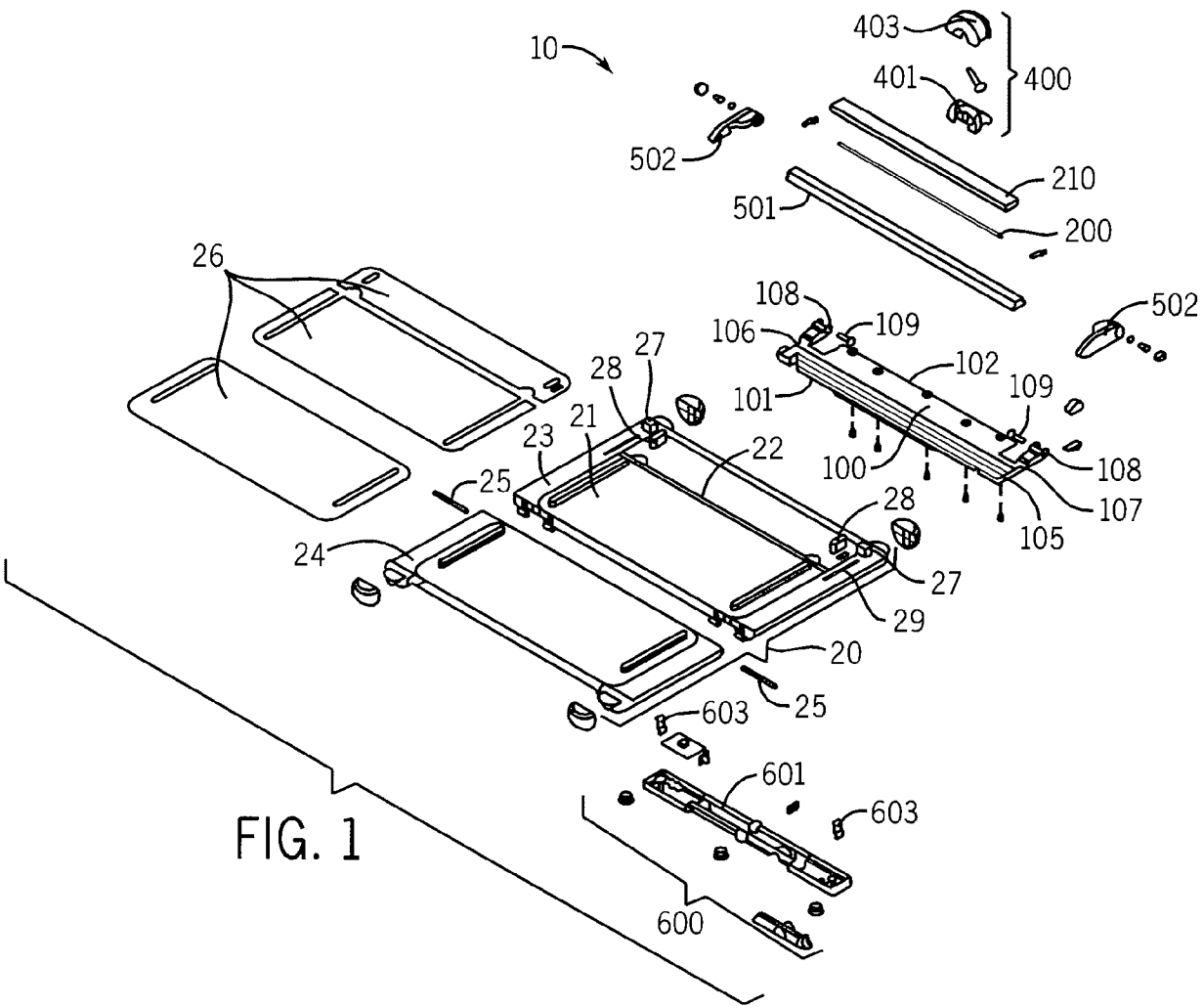
FIG. 1 is an exploded view of an illuminated material cutting system constructed in accordance with an embodiment of the present invention.
Figure 3A:
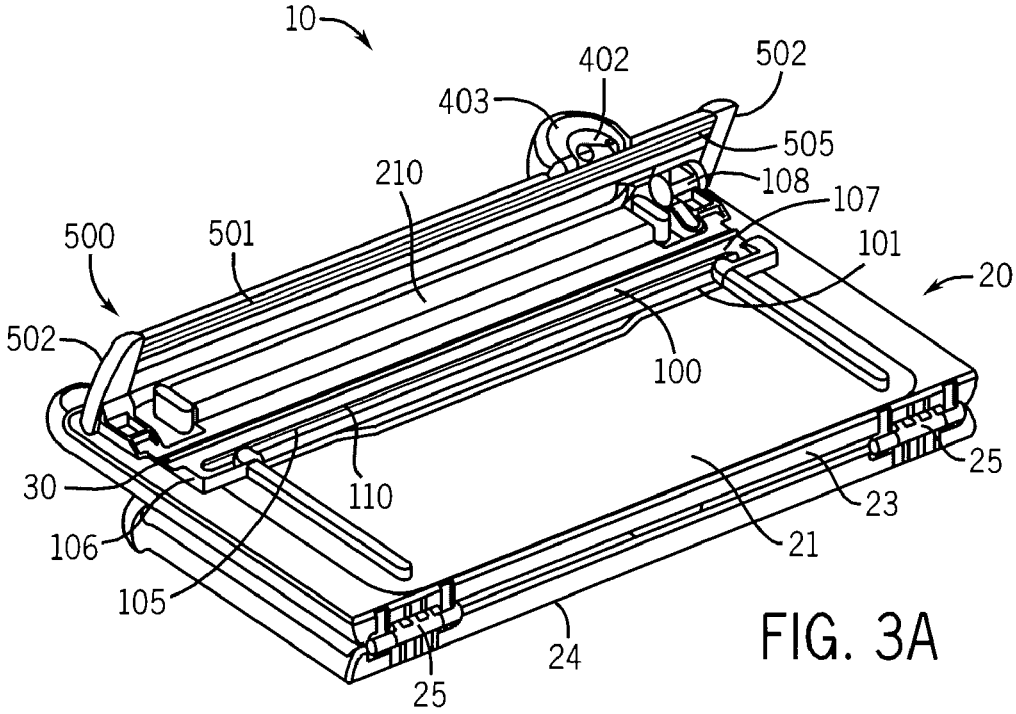
FIG. 3A is a perspective view of the illuminated material cutting system of FIG. 1, showing the cutting mechanism guide assembly in a raised orientation, the material guide in a cutting orientation and the base in a folded orientation.
Figure 3B:
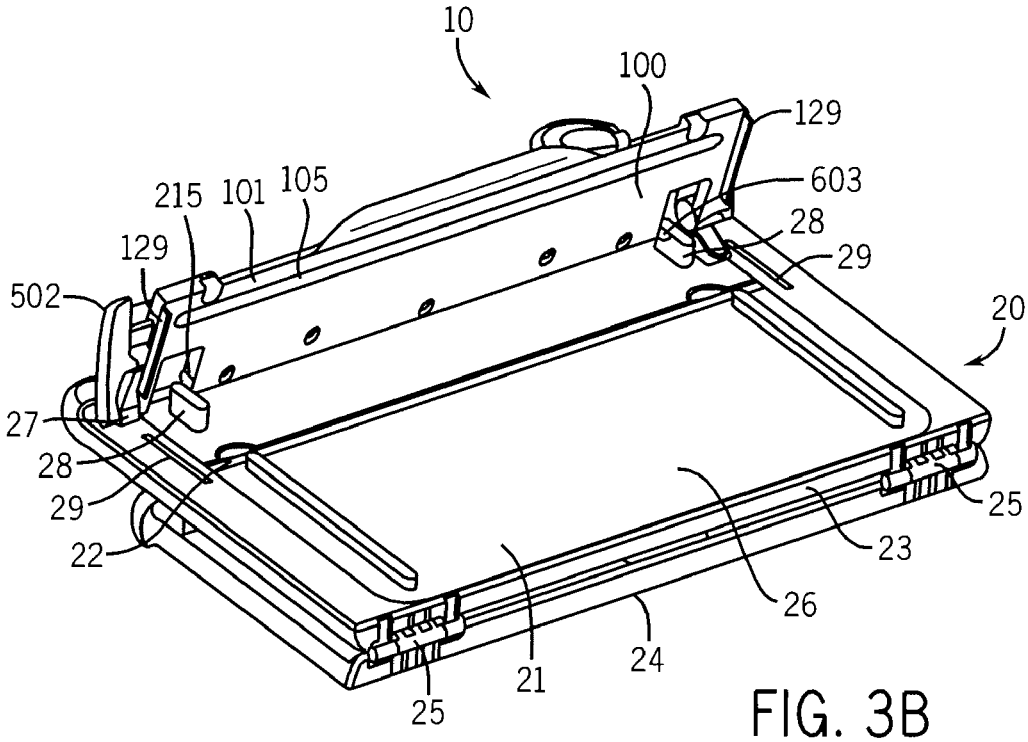
FIG. 3B is a perspective view of the illuminated material cutting system of FIG. 1, showing the cutting mechanism guide assembly and the material guide in a raised orientation and the base in a folded orientation.
Figure 4A:
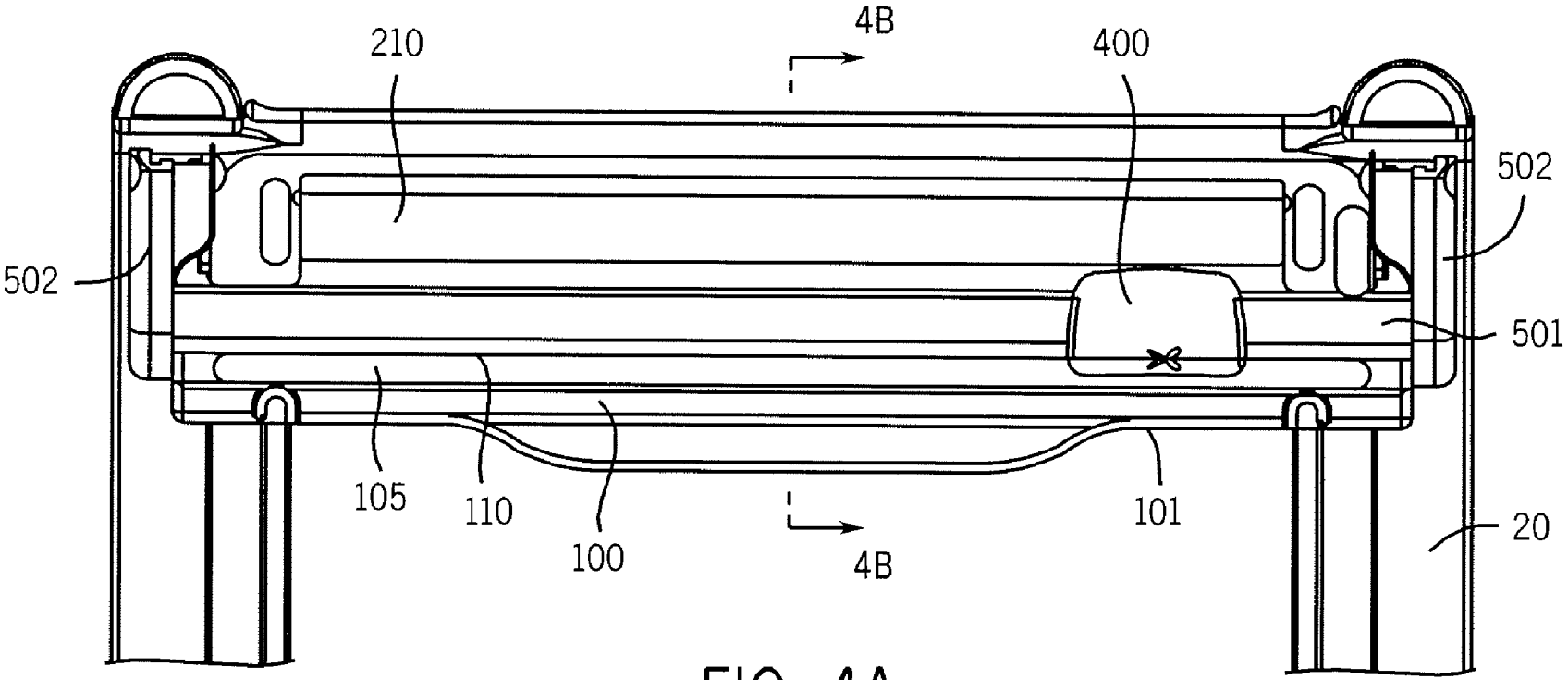
FIG. 4A is a top plan view showing a portion of the material cutting system of FIG. 1.
Figure 4B:
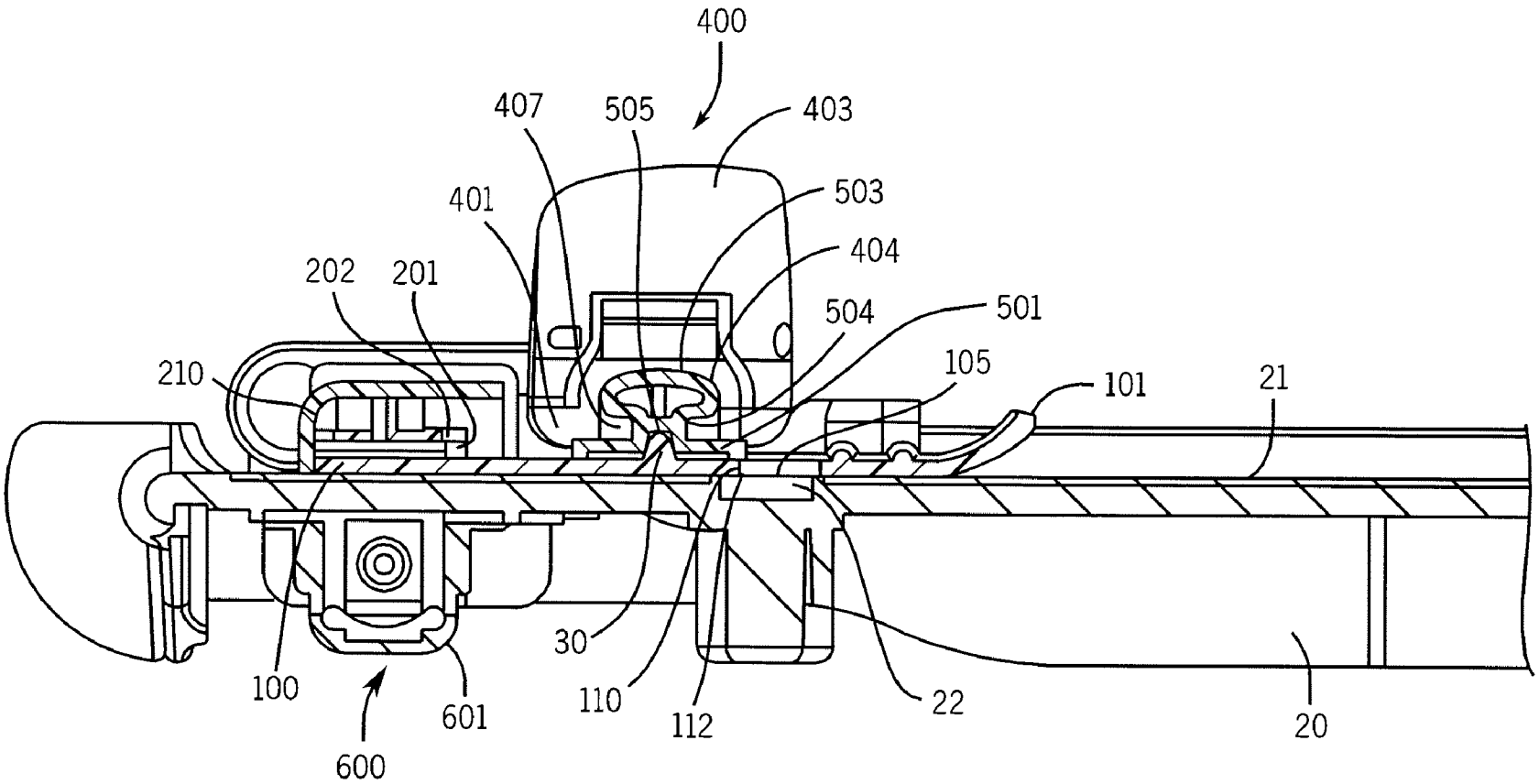
FIG. 4B is a cross-section view of the portion of the material cutting system shown in FIG. 4A.
Figure 5A:
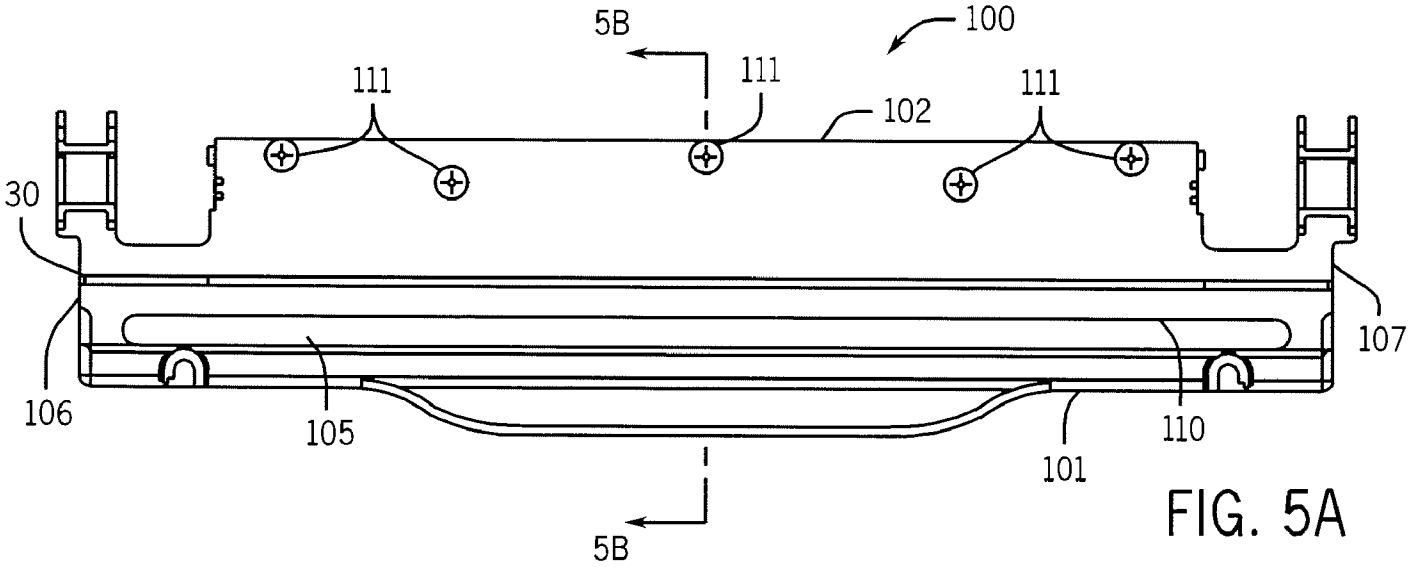
FIG. 5A is a top plan view of a portion of the material guide of the material cutting system of FIG. 1.
Figure 5B:
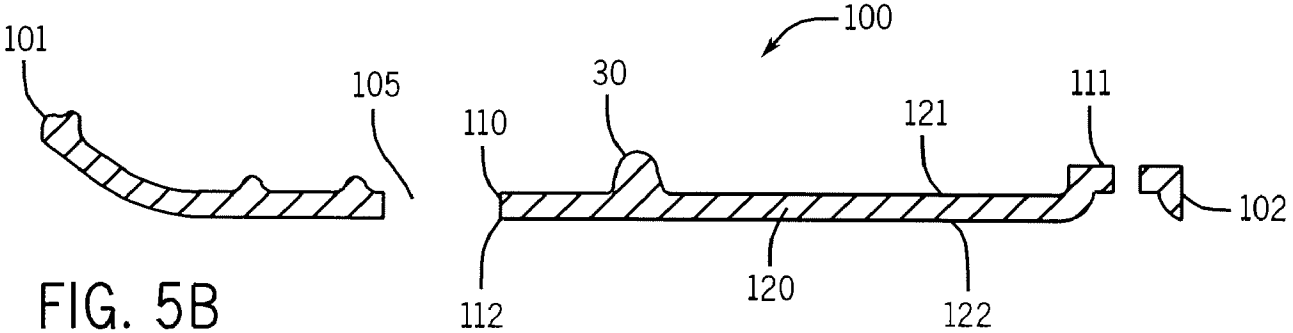
FIG. 5B is a cross-sectional view of the material guide shown in FIG. 5A.

FIGS. 1-4B illustrate a material trimmer 10 constructed in accordance with an embodiment of the present invention. As shown in FIG. 1, the material trimmer 10 comprises a material guide 100 operatively connected to a base 20 that is configured to receive sheet material (not shown), a cutting mechanism 400, and an illuminating assembly 200 operatively connected to the base 20. The material trimmer 10 may further comprise a cutting mechanism guide assembly 500 operatively coupled to the base 20 and configured to interface with the cutting mechanism 400. As seen in FIGS. 4A and 4B, the material guide 100 includes an illuminated surface 110 indicative of a cut line formable in the sheet material disposed between the material guide 100 and the base 20 by engagement of a blade portion 402 of the cutting mechanism 400. The illuminating assembly 200 is in optical communication with the illuminated surface 110 and provides light to internally illuminate the illuminated surface 110. The illuminated surface 110 is positioned in the material trimmer 10 to provide a visible indicia that an operator may use to align the sheet material relative to the base 20 such that a cut may be formed in the sheet material at a desired location on the sheet material.

Figure 2:
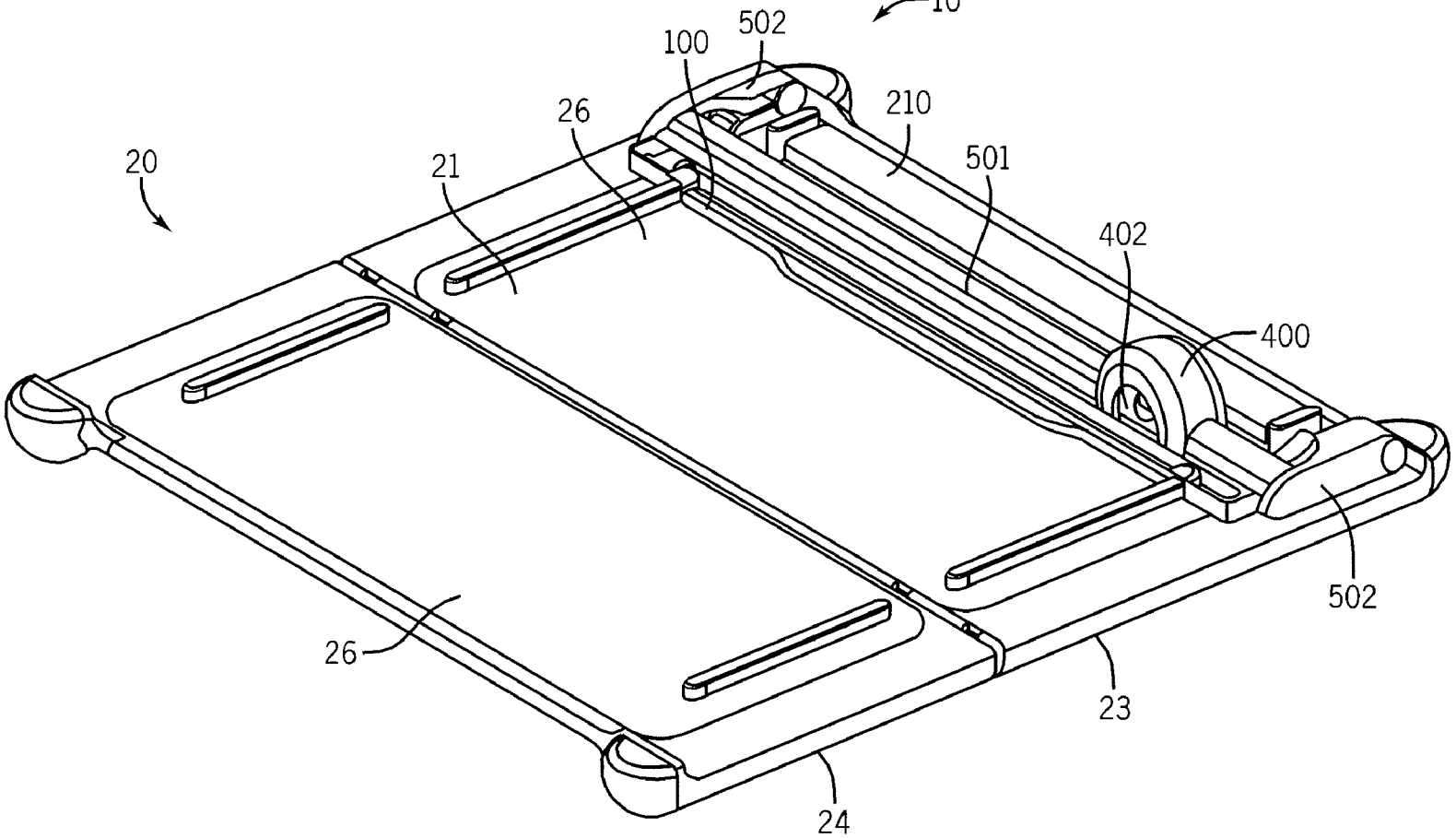
FIG. 2 is a perspective view of the illuminated material cutting system of FIG. 1, showing the cutting mechanism guide assembly and the material guide in a cutting orientation and the base in an extended orientation.

As illustrated in FIGS. 1 and 2, the base 20 defines a planar cutting surface 21 and is sized to accept one or more pieces sheet material to be trimmed using the material trimmer 10. The base 20 and the other features of the material trimmer 10 may be constructed to various dimensions to accommodate a variety of cutting tasks. For example, the material trimmer 10 and its features may be sized to accommodate paper and other materials typically encountered in consumer, commercial and office environments. However, the material trimmer 10 and its features may also be sized for cutting sizes and types of materials in industrial environments. As explained in more detail below, the cutting surface 21 of the base 20 may include a recessed portion 22 configured to receive at least a portion of the blade portion 402 of cutting mechanism 400.

The base 20 may further comprise a plurality of coupled segments that may be folded in relation to each other. As depicted, the base 20 includes a first base segment 23 and a second base segment 24. As best seen in FIGS. 3A and 3B, the first base segment 23 and the second base segment 24 are rotatably coupled via a hinge element 25. Thus, the base 20 may be selectively orientated between an extended configuration as shown in FIG. 2 and a folded configuration depicted in FIGS. 3A and 3B. The base 20 may be placed in the folded orientation for storage and/or trimming sheet material of relatively small area or sheet material that may not benefit from the full length of the base 20 in the extended configuration. The base 20 may also include additional folding segments or be of a fixed length. Additionally, the base 20 may include one or more veneers 26 depicted in FIGS. 1-3A. The one or more veneers 26 may be permanently or interchangeably located on portions of the cutting surface 21. The veneers 26 may include various graphics visible to an operator such a ruled markings and other indicia.

The material guide 100 is depicted in FIGS. 1-5B. The material guide 100 generally comprises a member comprising a leading edge 101 and a trailing edge 102 that is substantially parallel to the leading edge 101. The material guide 100 further includes an opening 105 that runs a length of the material guide 100 between a first end 106 and a second end 107. The opening 105 is substantially parallel to the leading edge 101 and the trailing edge 102 and as shown in the various Figures, disposed near the leading edge 101. The material guide 100 may be rotatably coupled to the base 20 near the trailing edge 102. Thus, the material guide 100 may be selectively rotated between a cutting orientation depicted in FIG. 3A where the principal plane of the material guide 100 is substantially parallel with the cutting surface 21, and a raised or open orientation depicted in FIG. 3B. FIGS. 3A and 3B for example, show a material guide connection portion 109 disposed at each of the first end 106 and the second end 107 of the material guide 100 proximate the trailing edge 102. Each of the material guide connection portions 109 are configured to partially receive a connecting element 108. Each of the connecting elements 108 are further partially receivable by a knuckle 27 coupled to and extending from the base 20, thereby rotatably coupling the material guide 100 to the base 20.

As seen in FIGS. 4A-5B, the opening 105 may comprise a slot through the material guide 100 and located near the leading edge 101. As such, the opening 105 defines a pair of substantially parallel surfaces running the length of the opening 105 and orientated substantially perpendicular to the plane of the cutting surface 21 when the material guide 100 is in the cutting orientation. In an embodiment, the illuminated surface 110 comprises one of the surfaces defined by the opening 105. In the depicted embodiment, the illuminated surface 110 is located along the portion of the opening 105 nearest the trailing edge 102 and is orientated substantially perpendicular to the cutting surface 21. The illuminated surface 110 is indicative of the location of the cut line of the material trimmer 10. The cut line represents the path that the blade portion 402 of the cutting mechanism 400 may engage the sheet material disposed beneath the opening 105 of the material guide 100. As such, the illuminated surface 110 is substantially parallel to the cut line and extends substantially perpendicular from the surface of the sheet material located below the material guide 100. The height of the illuminated surface 110 may be established to provide a clear indication to an operator of the location of the cut line. In a particular embodiment, the illuminated surface 110 has a substantially constant height over its length of about 2 mm. The opening 105 may be configured such that the illuminated surface 110 is proximate the blade portion 402 of the cutting mechanism 400. In a particular embodiment, the illuminated surface 110 is disposed such that the normal distance to the blade portion 402 is less than about 5 mm. In another embodiment, the normal distance between the illuminated surface 110 and the blade portion 402 is less than about 1 mm.

Light produced by the illuminating assembly 200 is internally transmitted to the illuminated surface 110. As shown in FIG. 4B, a portion of the material guide 100 comprises a light guide portion 120 that transmits light produced by the illuminating assembly 200 to the illuminated surface 110, thereby internally illuminating the illuminated surface 110. The illuminating assembly 200 comprises a plurality of light generating elements configured to produce light. In the depicted embodiment illustrated in FIGS. 7 and 8, the light generating elements comprise a plurality of light emitting diodes (LEDs) 201 disposed at intervals along an illuminating member 202. The illuminating member 202 conducts electrical energy from an energy source, such as one or more batteries, to each of the plurality of LEDs 201. The plurality of LEDs 201 may comprise white LEDs, colored LEDs or combinations thereof. The number of LEDs and spacing between the plurality of LEDs 201 may be a function of factors including the type of LED, length of the illuminated surface 110 and its desired brightness. In a particular embodiment shown in FIG. 8, the illuminating assembly 200 comprises eight LEDs, with each of the plurality of LEDs 201 on about 38 mm centers. One of skill in the art will appreciate that other configurations, including longer and shorter illuminating assemblies and assemblies of greater and fewer LEDs, are within the scope of the present application. In still other embodiments, the illuminating assembly 200 may comprise alternative light generating elements and/or arrangements.

As depicted in FIG. 4B, the illuminating assembly 200 is arranged such that the plurality of LEDs 201 are disposed just above and directed toward an upper surface of the material guide 100, near its trailing edge 102. In other embodiments, the plurality of LEDs may be located below and directed toward a lower surface of the material guide 100 or located along an edge of the material guide 100 and directed inwardly toward the illuminated surface 110. In still other embodiments, the material guide 100 may include a recessed portion configured to at least partially receive the plurality of LEDs 201. With references to FIGS. 4B and 5B, regardless of the particular location of the plurality of LEDs 201, the surface of the material guide 100 adjacent the plurality of LEDs 201 comprises an incidence surface 121. The light guide portion 120 further includes at least one reflective surface 122. Light emanating from the plurality of LEDs 201 enters the light guide portion 120 of the material guide 100 via the incidence surface 121. The light guide portion 120 is configured such that light entering from the incidence surface 121 is directed by the at least one reflective surface 122 to exit the light guide portion 120 at the illuminated surface 110. In various embodiments, including the depicted embodiment, the incidence surface 121 also comprises a reflective surface 122 over a portion of the light guide portion 120 distal from the plurality of LEDs 201. In a particular embodiment, the at least one reflective surface 122 comprises two reflective surfaces running substantially parallel to each other.

At least the light guide portion 120 of the material guide 100 comprises a substantially transparent material. The illuminated surface 110 also generally comprises a substantially transparent material. However, in various embodiments, the illuminated surface may be translucent, include a coating, or may be textured to achieve, for example, a diffused illumination effect. The reflective surfaces 122 may be substantially opaque or may be coated to enhance reflectance of light within the light guide portion 120 and transmittance of light from the illuminating assembly 200 to the illuminated surface 110. Surfaces adjacent to the reflective surfaces, for example, portions of the base 20 and the guide rail 501 may also be substantially opaque or include a coating to enhance reflectance of light within the light guide portion 120 and direct light to the illuminated surface 110. The geometry of the light guide portion 120 may also be configured to enhance illumination at the illuminated surface 110. In a particular embodiment, the light guide portion 120 has a substantially uniform thickness of about 2 mm.

Figure 7:
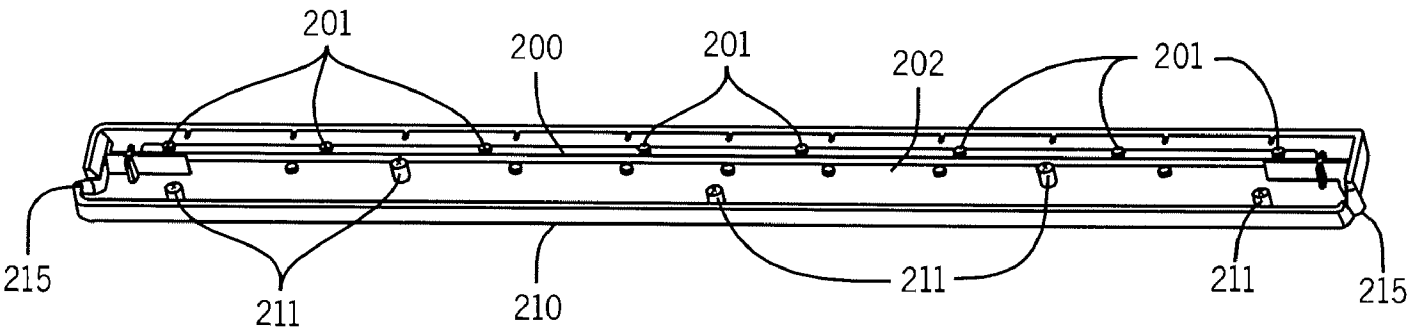
FIG. 7 is a perspective view of the illuminating assembly within the illuminating assembly cover of the material cutting system of FIG. 1.
Figure 8:
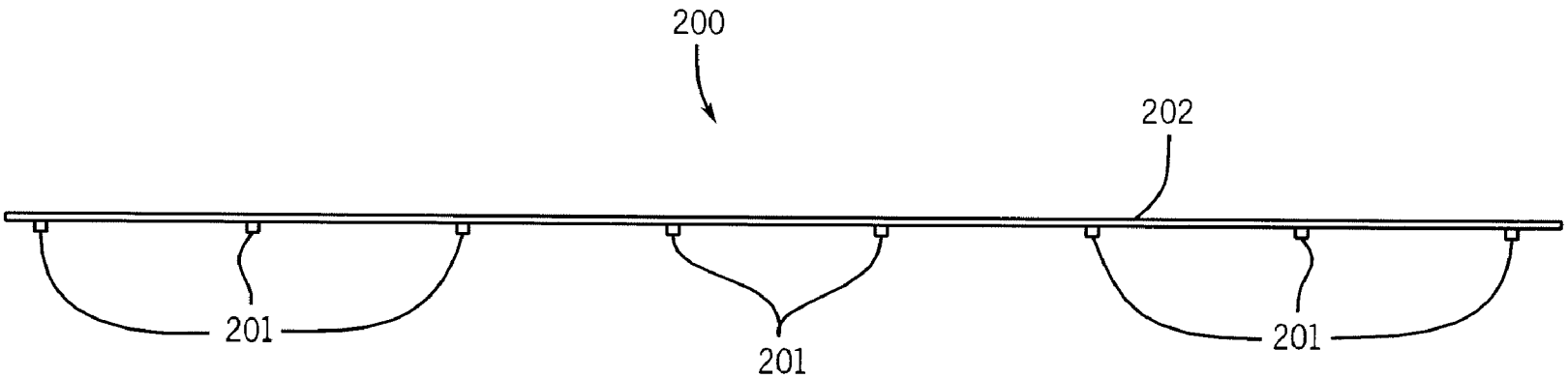
FIG. 8 is a side view of the illuminating assembly of the material cutting system of FIG. 1.

As shown in FIG. 7, the illuminating assembly 200 is received within an illuminating assembly cover 210. The illuminating assembly cover 210 may include retaining features configured to hold the illuminating assembly 200 in place such as by a "snap fit." The illuminating assembly 200 may also be adhesively secured to the illuminating assembly cover 210. The illuminating assembly cover 210 is configured for attachment to the material guide 100 and comprises a substantially opaque material. As shown, the illuminating assembly cover 210 includes a plurality of cover bosses 211. The plurality of cover bosses 211 are substantially aligned with a plurality of guide bosses 111 located on the material guide 100. Each of the plurality of cover bosses 211 and each of the plurality of guide bosses 111 are configured to receive a connecting element to secure the illuminating assembly cover 210 to the material guide 100 as shown in FIGS. 2 and 3A. The illuminating assembly cover 210 further includes connections that electrically couple the illuminating assembly 200 to a power source. As shown in FIGS. 7 and 3B, a first set of electrical contacts 215 may be disposed at the ends of the illuminating assembly cover 210.

Figure 6:
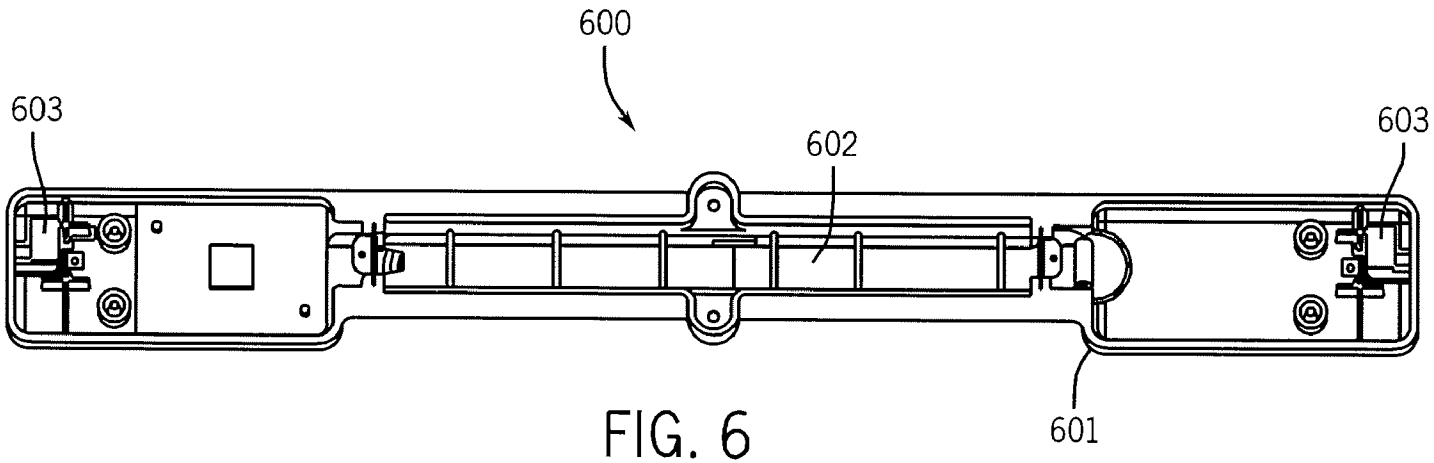
FIG. 6 is a top plan view of the power supply assembly of the material cutting system of FIG. 1.

The material trimmer 10 may further include a power supply to provide electrical energy to the illuminating assembly 200 and thus power the plurality of LEDs 201. FIG. 6 illustrates an embodiment of a power supply assembly 600. In the depicted embodiment, the power supply assembly 600 includes a housing 601. The housing 601 defines a battery compartment 602 configured to receive at least one battery (not shown) to power the illuminating assembly 200. In a particular embodiment, the battery compartment 602 is sized to hold three "AAA" size batteries. Alternative and/or additional sources of electrical power may be used, including a conventional AC/DC power transformer. The battery compartment 602 is electrically coupled to a second set of electrical contacts 603. As shown in FIG. 6, the second set of electrical contacts 603 are disposed at the ends of the housing 600. As shown in FIG. 4B, the power supply assembly 600 may be located beneath the base 20, opposite the cutting surface 21.

As depicted in FIG. 3B, each of the second set of electrical contacts 603 may be configured to pass through openings in the base 20 and positioned in relation to towers 28 that extend from the base 20. Thus, when the material guide 100 is rotated into the cutting orientation shown in FIG. 3A, the first set of electrical contacts 215 engage the second set of electrical contacts 603, electrically coupling the illuminating assembly 200 with the power source. When the material guide 100 is rotated away from the base 20 to the open orientation, the first set of electrical contacts 215 disengage from the second set of electrical contacts 603. Thus, electrical power to the illuminating assembly 200 may be selectively provided based on the orientation of the material guide 100 in relation to the base 20. The material trimmer 10 may further comprise an interface such as a switch to selectively control the provision of electrical power to the illuminating assembly 200. Additionally, in other embodiments, the illuminating assembly cover 210 may be configured to house the power supply of the material trimmer 10.

In the cutting orientation shown in FIG. 3A, the principal plane of the material guide 100 is substantially parallel to the cutting surface 21 of the base 20. In the cutting orientation, the material guide 100 is located over the sheet material received by the base 20. The opening 105 is located in the material guide 100 such that in the cutting orientation, the opening 105 is substantially parallel to and positioned over the recessed portion 22 of the base 20. FIG. 4B further depicts the orientation of the opening 105 in relation to the recessed portion 22. As explained below, the blade portion 402 of the cutting mechanism 400 is receivable through the opening 105 and engageable with the sheet material over substantially the length of the opening 105. In the open orientation shown in FIG. 3B, the leading edge 101 of the material guide 100 is rotated away from the cutting surface 21 of the base 20. In this open orientation, sheet material may be readily placed on the cutting surface 21. However, the material trimmer 10 may also be configured such that sheet material may be slid between the material guide 100 and the base 20 while the material guide 100 is in the cutting orientation. The base 20 may also include registration features 29 that assist in aligning and maintaining the material guide 100 with the base in the cutting orientation. As shown in the FIG. 3B, the registration features 29 mate with complimentary alignment protrusions 129 located in the material guide 100.

With reference to 3A and 5A, the illuminated surface 110 runs substantially the length of the opening 105 and is orientated in relation to the guide rail 501 and the cutting mechanism 400 such that the illuminated surface 110 is indicative of the location of where the blade portion 402 will engage the underlying sheet material, i.e. the cut line. The illuminated surface 110 is constructed such that it is readily observable by an operator when aligning sheet material in the material trimmer 10 and during the cutting operation.

As seen in FIGS. 2 and 3A, the material trimmer 10 may include a cutting mechanism guide assembly 500. The cutting mechanism guide assembly 500 comprises a guide rail 501 coupled to at least one of a guide rail arm 502. As depicted, a guide rail arm 502 is coupled to each end of the guide rail 501. Each of the guide rail arms 502 is further rotatably coupled to the base 20. In the depicted embodiment, the guide rail arms 502 are coupled to the to base 20 at the knuckles 27 where the material guide 100 is rotatably coupled to the base 20. Accordingly, the cutting mechanism guide assembly 500 is rotatably coupled to the base 20 and is rotatable about a substantially common axis with respect to the material guide 100. In alternative embodiments, cutting mechanism guide assembly 500 may be independently coupled to the base 20 and/or to the material guide 100. In other embodiments, the material trimmer 10 may not include a cutting mechanism guide assembly 500. Instead, the cutting mechanism 400 or blade may be received directly by the material guide 100 and/or the opening 105. In the depicted embodiment, the cutting mechanism guide assembly 500 may be rotated between a cutting orientation shown in FIG. 2 and raised orientations depicted in FIGS. 3A and 3B. As shown in FIGS. 3A and 3B, the cutting mechanism guide assembly 500 may be rotated independently of the material guide 100.

FIG. 4B shows a cross-section of an embodiment of the guide rail 501. As described in more detail below, the guide rail 501 is configured to restrain unwanted movement of the cutting mechanism 400 over the length of the guide rail 501 such that the material trimmer 10 achieves a true and repeatable cut. It will be appreciated that the guide rail 501 may be constructed in a variety of geometries to achieve the desired constraint on the cutting mechanism 400. In the depicted embodiment, the guide rail 501 comprises a rounded top portion 503 and an undercut portion 504. The guide rail 501 may further include a registration feature 505 configured to engage with a corresponding alignment feature 30 disposed on an upper surface of the material guide 100. As shown in FIG. 4B, the registration feature 505 receives the alignment feature 30 when the cutting mechanism guide assembly 500 and the material guide 100 are placed in the cutting orientation, further maintaining alignment of the cutting mechanism 400 in relation the material guide 100 during sheet material alignment and cutting operations.

With reference to FIGS. 1, 2 and 4B, an embodiment of the cutting mechanism 400 is shown. The cutting mechanism 400 is adapted for sliding engagement along a length of the guide rail 501. The cutting mechanism 400 comprises a carnage guide 401, a carriage housing 403 coupled to the carriage guide 401, and a blade portion 402 extending from the carriage housing 403. As shown in FIG. 4B, the carriage guide 401 includes a guide opening 404. The guide opening 404 is configured to substantially mate with the features of the guide rail 501. By minimizing the clearance between the surfaces of the guide opening 404 and the guide rail 501, undesirable rotation and translation of the carriage guide 401 and the cutting mechanism 400 in relation to the guide rail 501 and in turn the opening 105 may be minimized during operation of the material trimmer 10. Thus, the material trimmer 10 may obtain a substantially linear cut in the sheet material along the cut line. For example, in the embodiment depicted in FIG. 4B, the carriage guide 401 includes a foot 407 that extends into the undercut portion 504 and an upper guide surface that substantially conforms to the rounded portion 503. The carriage housing 403 may selectively attachable to carriage guide 401 to allow for removal and replacement of the blade portion 402.

The blade portion 402 is configured to pass through the opening 105 when the material guide 100 is in the cutting orientation and to engage the underlying sheet material positioned between the material guide 100 and the base 20. As shown in FIG. 4B, in embodiments of the material trimmer 10 that include a recessed portion 22, the blade portion 402 may be configured to extend at least partially into the recessed portion 22. The blade portion 402 may comprise various types of cutting elements applicable to cutting a variety of types of sheet material. In an embodiment, the blade portion 402 is rotatably coupled in relation to the carriage housing 403. Regardless of the blade type, the cutting mechanism 400 travels along a substantially linear path defined by the guide rail 501. The blade portion 402 in particular travels along a cut line that is substantially parallel to the guide rail 501 and is defined by the path of engagement of the blade portion 402 with the sheet material.

As indicated in FIGS. 4A and 4B, the guide rail 501, cutting mechanism 400 and the material guide 100 may be configured such that the location of the cut line is proximate the illuminated surface 110. As such, the illuminated surface 110 is indicative of the location of the cut line that is formable in the sheet material by engagement with the blade portion 402. Specifically, a lower edge 112 of the illuminated surface approximates the location of engagement of the blade portion 402 and the sheet material. In a particular embodiment, the material trimmer 10 is arranged such that the normal distance between the cut line and the illuminated surface 110 is less than about 5 mm. In another embodiment, the normal distance between the cut line and the illuminated surface 110 is less than about 1 mm. In still another embodiment, a lateral surface of the blade portion 402 is in sliding contact with the illuminated surface 110. Accordingly, the illuminated surface 110 is used by an operator to accurately align the sheet material on the base 20 so that the sheet material may be trimmed at the desired location by the material trimmer 10.

In operation, one or more pieces of sheet material to be trimmed using the material trimmer 10 are placed on the base 20. The material guide 100 may be raised to the open orientation shown in FIG. 3B by rotating the leading edge 101 away from the cutting surface 21 to facilitate initial placement of the sheet material on the base 20. However, sheet material may also be slid between the cutting surface 21 and the material guide 100. The illuminated surface 110 is illuminated by the illuminating assembly 200. Power may be supplied to the illuminating assembly 200 by manipulation of an interface by an operator or automatically coupling the illuminating assembly 200 to the power source, which may be accomplished by lowering the material guide 100 to the cutting orientation. The illuminated surface 110 is visible via the opening 105 by the operator and is indicative of the location of the cut line formable in the sheet material by operation of the cutting mechanism 400. Thus, the operator may manipulate the sheet material beneath the material guide 100 by rotating the sheet material in the plane of the cutting surface 21 and/or translating the sheet material in the plane of the cutting surface 21 in order to arrange the sheet material relative to the illuminated surface 110. Once the sheet material has been positioned such that the desired location of the cut line is orientated in relation to the illuminated surface 110, the user may cut the sheet material using the cutting mechanism 400 or other cutting instrument. The user may grasp the cutting mechanism 400 and translate the cutting mechanism 400 along the guide rail 501, engaging the blade portion 402 with the sheet material over the cut line. The sheet material is thereby trimmed, and the operator may thereafter remove the one or portions of sheet material from the material trimmer 10 either by opening the material guide 100 or by sliding the sheet material from beneath the material guide 100. An accurately located cut in the sheet material may thus be obtained by aligning the sheet material in relation to the illuminated surface 110.

Figure 9A:
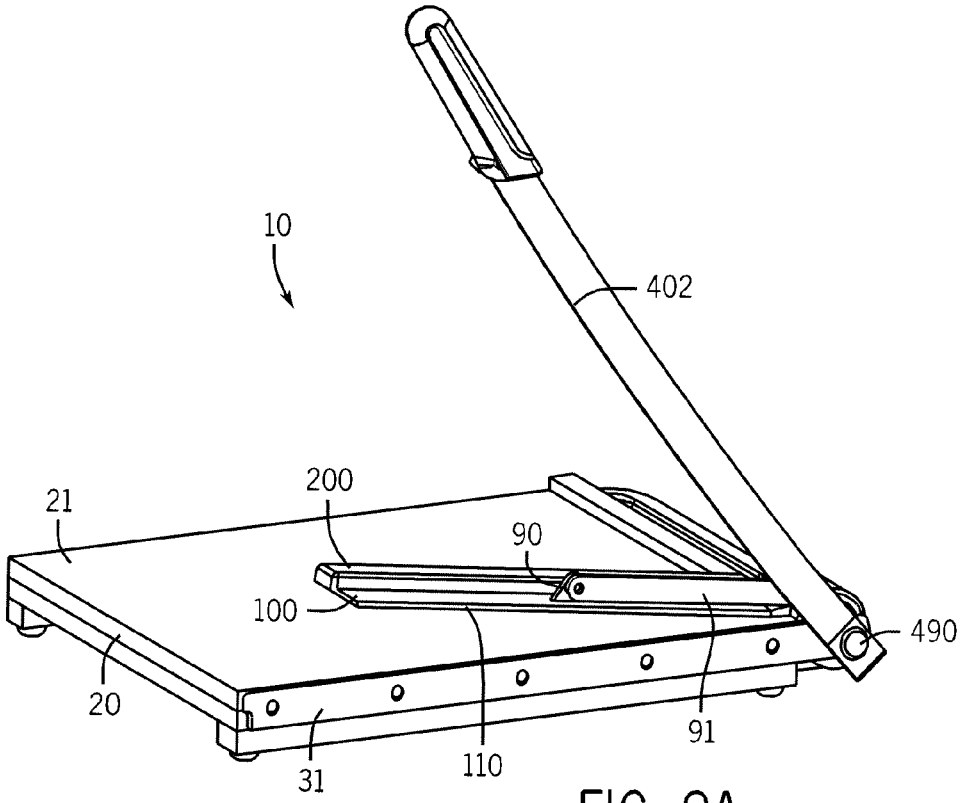
FIG. 9A is an perspective view of an illuminated material cutting system constructed in accordance with another embodiment of the present invention, showing the cutting guide in a raised orientation.
Figure 9B:
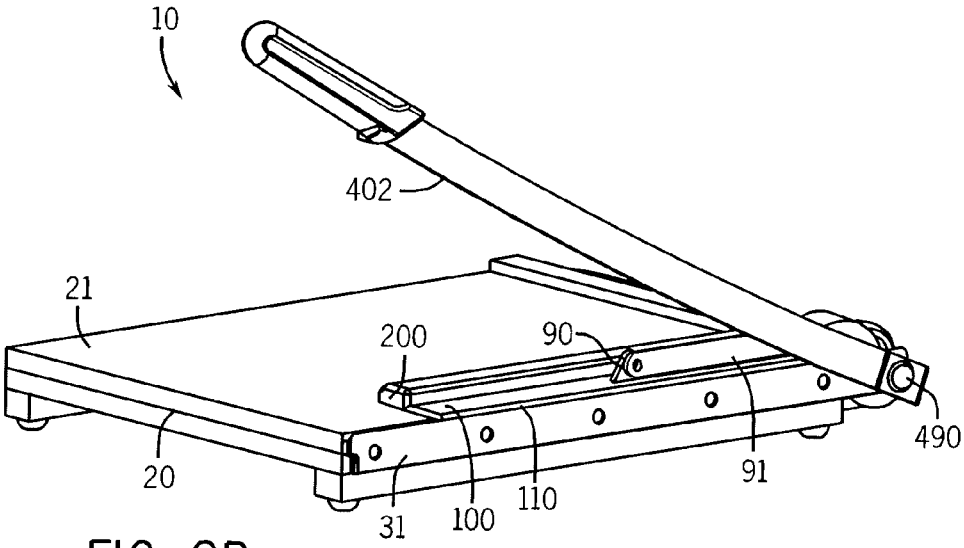
FIG. 9B is a perspective view of the illuminated material cutting system of FIG. 9A, showing the material guide in a cutting orientation.
Figure 10:
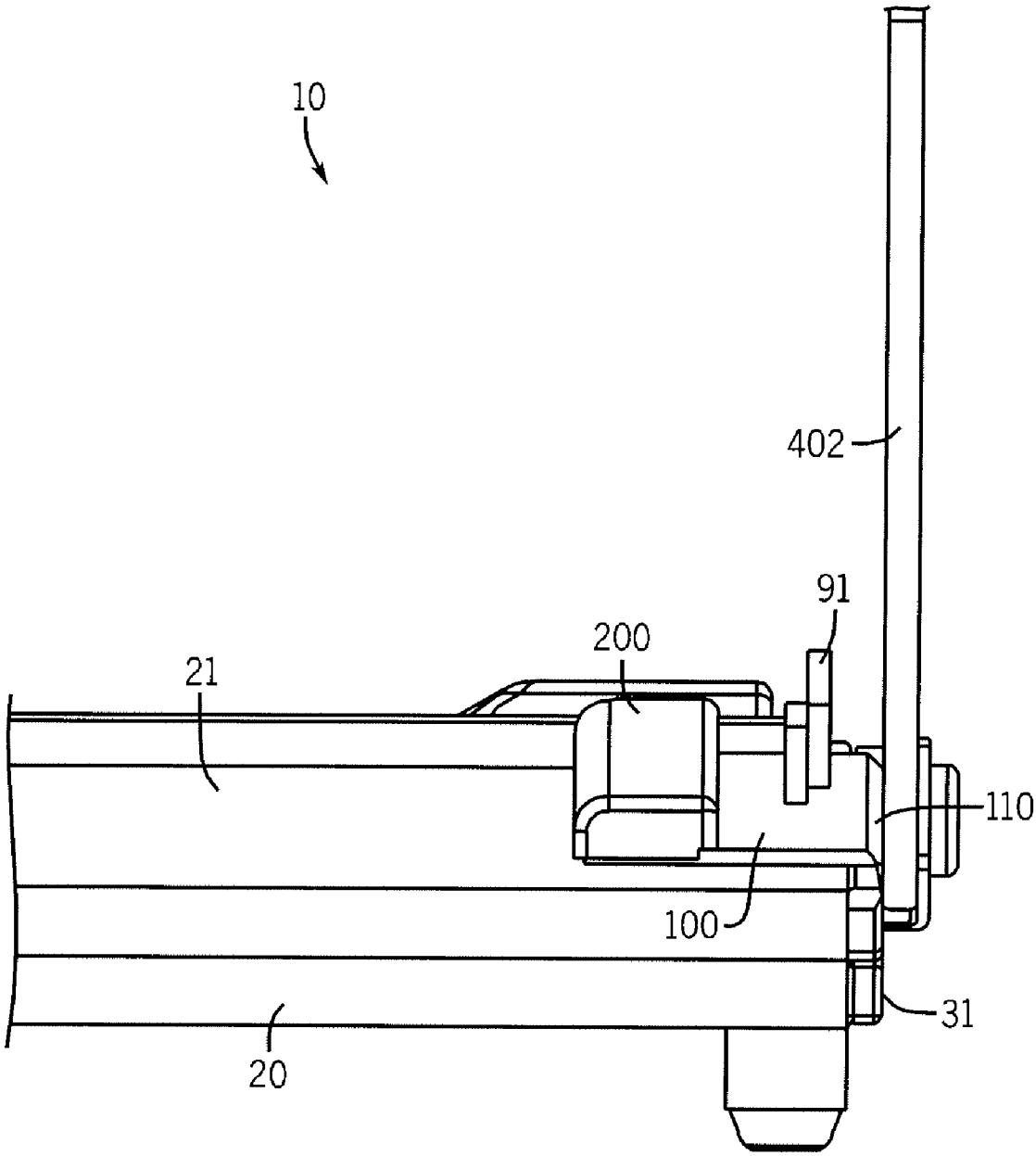
FIG. 10 is a front view of a portion of the illuminated material cutting system of FIG. 9A.

FIGS. 9A-10 depict another embodiment of the cutting system 10, where the blade portion 402 is rotatably coupled to the base 20 at a blade hinge 490. In this "guillotine style" embodiment, the blade portion 402 engages the sheet material proximate a base end 31 by a downward rotation of an end of the blade portion 402 toward the cutting surface 21. The material trimmer 10 may be configured such that the cut line is proximate the base end 31. A material guide assembly 90 may also be rotatably coupled to the base 20 to rotate about an axis substantially parallel to the axis of rotation of the blade portion 402. The material guide assembly 90 comprises a material guide 100 coupled to a illuminating assembly 200. A link 91 may be coupled to at least one of the material guide 100 and the illuminating assembly 200, and the link 91 is rotatably coupled to the base 20. As such, the material guide 100 may be selectively rotated between a cutting orientation (depicted in FIG. 9B), where the principal plane of the material guide 100 is substantially parallel with the cutting surface 21, and the raised or open orientation depicted in FIG. 9A. In the cutting orientation, the material guide 100 is located over the sheet material received by the base 20. In the raised orientation, sheet material may be readily placed on the cutting surface 21.

As depicted in FIG. 9B, An illuminated surface 110 runs along a length of the material guide 100 and is orientated proximate the base end 31 when the material guide 100 is in the cutting orientation. As such, the illuminated surface 110 is indicative of the location of where the blade portion 402 will engage the underlying sheet material, i.e. the cut line. The illuminated surface 110 is constructed such that it is readily observable by an operator when aligning sheet material in the material trimmer 10 and during the cutting operation. As depicted in FIG. 10, the illuminated surface 110 may be inclined to improve visibility of the surface from above the cut line. The illuminated surface 110 is internally illuminated by light produced by the illuminating assembly 200 that is transmitted within the material guide 100 to the illuminated surface 110. As described above, the illuminating assembly 200 may comprise a plurality of light generating elements, for example, a plurality of LEDs, configured to produce light. The illuminating assembly 200 is coupled to an electrical power supply that may be located on the material guide assembly 90 or coupled to the base 20.

Embodiments of the material trimmer 10 may be particularly useful for efficiently and precisely trimming paper materials. However, one skilled in the art will appreciate that the present invention is not limited to trimming paper materials but may be employed to cut a variety of relatively thin sheet materials, including fabric, polymer, rubber, metal, wood, glass and gypsum board. Additionally, it will be appreciated that multiple layers of the same or different materials may be cut simultaneously using the material trimmer 10.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described to explain the principles of the present invention and its practical application to enable one skilled in the art to utilize the present invention in various embodiments and with various modifications as are suited to the particular use contemplated.

What is claimed is:

1. An illuminated cutting system for cutting sheet material, comprising:

a base configured to receive the sheet material;

a material guide coupled to the base, the material guide selectively rotatable between a material loading orientation and a cutting orientation, the material guide located above the sheet material and configured to hold the sheet material against the base when in the cutting orientation, the material guide including a blade opening having an illuminated surface, wherein in the cutting orientation, the illuminated surface is substantially perpendicular to the sheet material, with the illuminated surface including an edge indicative of a cut line disposed proximate the sheet material and proximate a path of travel of a cutting mechanism blade across the sheet material;

an illuminating assembly in optical communication with the material guide and electrically coupled to a power source, the illuminating assembly including a light source positioned to transmit light through a portion of the material guide and illuminate the illuminated surface; and a cutting mechanism guide coupled to at least one of the base and the material guide, wherein the sheet material is alignable in relation to the illuminated surface for cutting in the illuminated cutting system, and wherein at least a portion of the material guide comprises a light guide including a reflective surface, the reflective surface configured to direct light emanating from the illuminating assembly to the illuminated surface.

2. The illuminated cutting system of claim 1, wherein the light source comprises a plurality of light emitting diodes.

3. The illuminated cutting system of claim 2, wherein the light guide further comprises:

a light incidence surface configured to receive light from the plurality of light emitting diodes; and a light emission surface substantially defined by the illuminated surface, wherein the light reflecting surface is disposed between the light incidence surface and the light emission surface.

4. The illuminated cutting system of claim 2, wherein the material guide includes a recessed portion partially defined by the light incidence surface, the recessed portion configured to at least partially receive the plurality of light emitting diodes.

5. The illuminated cutting system of claim 1, wherein the edge is less than or about 1 mm from the cut line.

6. The illuminated cutting system of claim 5, wherein the cutting mechanism is selectively attachable to the cutting mechanism guide.

7. The illuminated cutting system of claim 1, wherein the material guide includes an upper surface and a cutting mechanism guide alignment feature disposed along a length of the upper surface, and wherein the cutting mechanism guide is selectively engageable with the cutting mechanism guide alignment feature.

8. A system for cutting sheet material, comprising:

a base configured to receive the sheet material;

a cutting mechanism having a blade, the cutting mechanism operatively coupled to the base and engageable with the sheet material along a cut line;

a material guide coupled to the base, the material guide having an alignment surface disposed above and proximate the sheet material and substantially indicating the location of the cut line, the material guide including at least one reflective surface;

an illuminating assembly including at least one light emitting diode in optical communication with the material guide; and a power supply selectively electrically coupled to the illuminating assembly, wherein a portion of the material guide internally transmits light emitted from the illuminating assembly to the alignment surface, thereby providing an illuminated visual indicia of the cut line, and wherein the at least one reflective surface is used to direct light emanating from the illuminating assembly through the material guide to the alignment surface.

9. The system of claim 8, wherein the alignment surface defines an edge proximate the cut line, the edge disposed over substantially the full length of the cut line.

10. The system of claim 9, wherein the material guide is selectively rotatable between a material loading orientation, where a portion of the material guide is elevated above the base, and a cutting orientation, where a surface of the material guide is substantially parallel to the base.

11. The system of claim 10, wherein the alignment surface is substantially perpendicular to the sheet material in the cutting orientation, and wherein the alignment surface is disposed less than about 5 mm from the cut line when the material guide is in the cutting orientation.

12. The system of claim 8, wherein the blade is rotatably coupled to the base and engageable with the sheet material over substantially the length of the cut line.

* * * * *